US010059012B2

(12) United States Patent
Kim

(10) Patent No.: US 10,059,012 B2
(45) Date of Patent: Aug. 28, 2018

(54) SCISSORS

(71) Applicant: Jeong Pyo Kim, Seoul (KR)

(72) Inventor: Jeong Pyo Kim, Seoul (KR)

( * ) Notice: Subject to any disclaimer, the term of this patent is extended or adjusted under 35 U.S.C. 154(b) by 135 days.

(21) Appl. No.: 14/344,159

(22) PCT Filed: Mar. 11, 2013

(86) PCT No.: PCT/KR2013/001926

§ 371 (c)(1),
(2) Date: Mar. 11, 2014

(87) PCT Pub. No.: WO2013/151245

PCT Pub. Date: Oct. 10, 2013

(65) Prior Publication Data

US 2015/0033563 A1 Feb. 5, 2015

(30) Foreign Application Priority Data

Apr. 4, 2012 (KR) ..... 10-2012-0034696
Mar. 11, 2013 (KR) ..... 10-2013-0025495

(51) Int. Cl.
*B26D 7/00* (2006.01)
*B26B 13/06* (2006.01)

(52) U.S. Cl.
CPC ..... *B26B 13/06* (2013.01)

(58) Field of Classification Search
CPC ..... B23B 13/06; B26D 7/00
USPC ..... 30/173, 175, 230, 258, 279.2, 179
See application file for complete search history.

(56) References Cited

U.S. PATENT DOCUMENTS 166,208 A * 8/1875 Lehman ..... 30/118
166,908 A * 8/1875 lehman ..... 119/767
317,981 A * 5/1885 Osborne ..... 213/182
483,884 A * 10/1892 welmer ..... 30/230
519,626 A * 5/1894 Brooks ..... 30/363
584,925 A * 6/1897 Cooke ..... 30/359
768,347 A * 8/1904 slaughter ..... 30/176
(Continued)

FOREIGN PATENT DOCUMENTS

CN 201361883 Y 12/2009
DE 297 05 219 U1 5/1997
(Continued)

*Primary Examiner* — Sean Michalski
*Assistant Examiner* — Fernando Ayala
(74) *Attorney, Agent, or Firm* — Stein IP, LLC

(57) ABSTRACT

The present invention relates to rounded blade scissors. The rounded blade scissors according to one embodiment of the present invention comprise: a first cutting portion including a first cutting blade bent in one direction to cut a target; a second cutting portion including a second cutting blade having a closed annular or polygonal shape to surround the surface of the first cutting portion; a first frame portion supporting the first cutting portion on one side of the first cutting portion; a second frame portion supporting the second cutting portion on one side of the second cutting portion; and a coupling portion that hingedly couples the first frame portion with the second frame portion so that the first cutting portion comes into contact with the second frame portion through rotation. Therefore, the cutting can be performed in a safe and effective manner. According to the present invention, the cutting target can be cut in an easy, convenient, and safe manner.

4 Claims, 8 Drawing Sheets

(56) References Cited

U.S. PATENT DOCUMENTS

| | | | | | |
|---|---|---|---|---|---|
| 865,551 | A | * | 9/1907 | wells | 606/174 |
| 1,085,793 | A | * | 2/1914 | Boettger | 452/64 |
| 1,364,137 | A | * | 1/1921 | Pannier | 606/184 |
| 1,482,291 | A | * | 1/1924 | England | 30/38 |
| 2,078,827 | A | * | 4/1937 | Ashton | 40/302 |
| 2,525,450 | A | * | 10/1950 | Amato Celestino | B26B 13/00 30/233 |
| 2,994,321 | A | | 8/1961 | Tischler | |
| 3,259,981 | A | * | 7/1966 | Raymond et al. | 30/289 |
| 3,284,991 | A | * | 11/1966 | Ploeger et al. | 95/30 |
| 4,246,698 | A | * | 1/1981 | Lasner | A61B 17/0467 30/134 |
| 4,291,464 | A | * | 9/1981 | Garrett | 30/363 |
| 4,327,487 | A | | 5/1982 | Brownell | |
| 6,237,224 | B1 | * | 5/2001 | Park | 30/29.5 |
| 9,084,606 | B2 | * | 7/2015 | Greep | A61B 18/1445 |
| 2012/0285021 | A1 | * | 11/2012 | Park et al. | 30/29.5 |

FOREIGN PATENT DOCUMENTS

| | | | |
|---|---|---|---|
| KR | 10-2000-0000508 | A | 1/2000 |
| KR | 20-2000-0012316 | U | 7/2000 |
| KR | 10-2006-0123794 | A | 12/2006 |
| KR | 10-2010-0079789 | A | 7/2010 |
| KR | 10-0972030 | B1 | 7/2010 |

* cited by examiner

[Fig. 1]
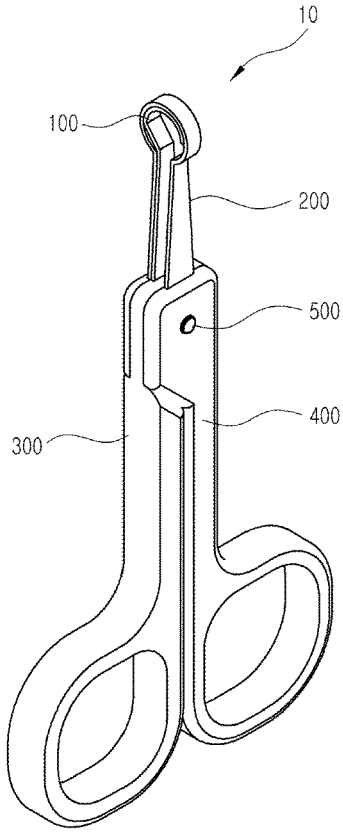
[Fig. 2]
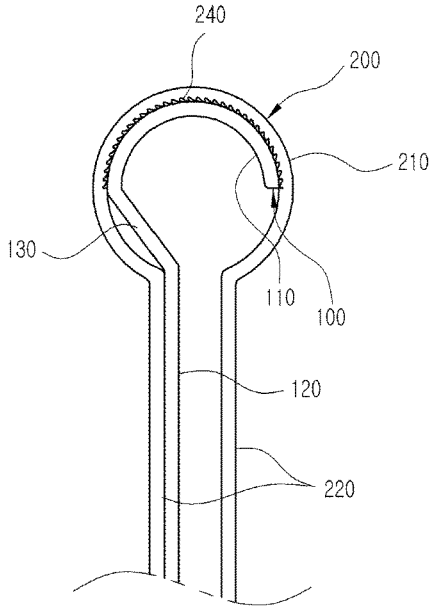

[Fig. 3]
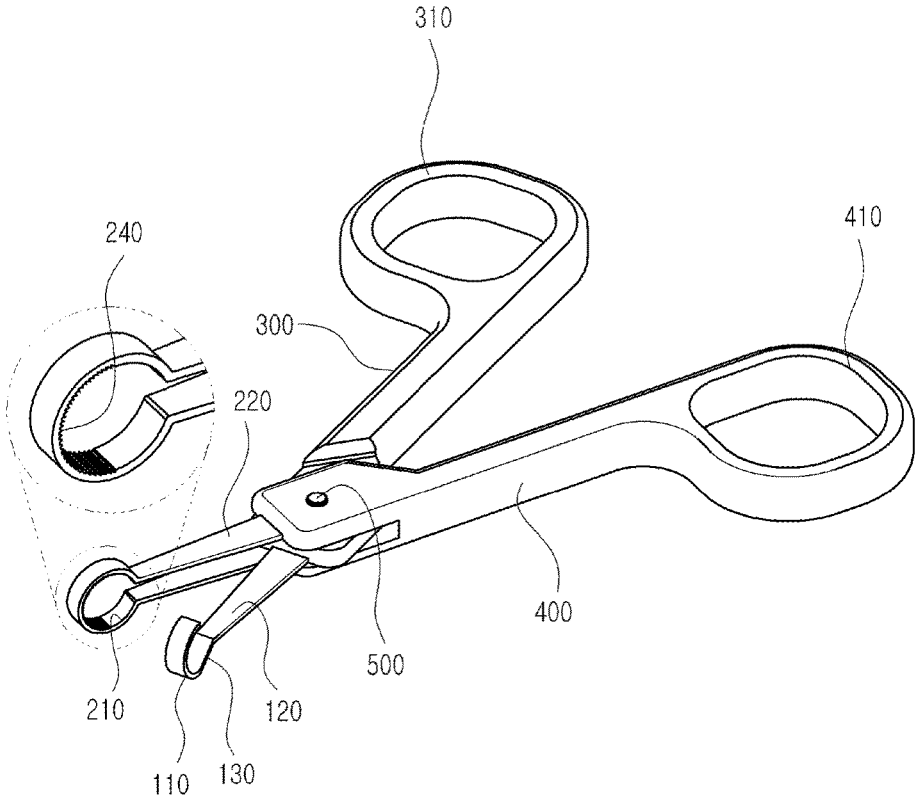
[Fig. 4]
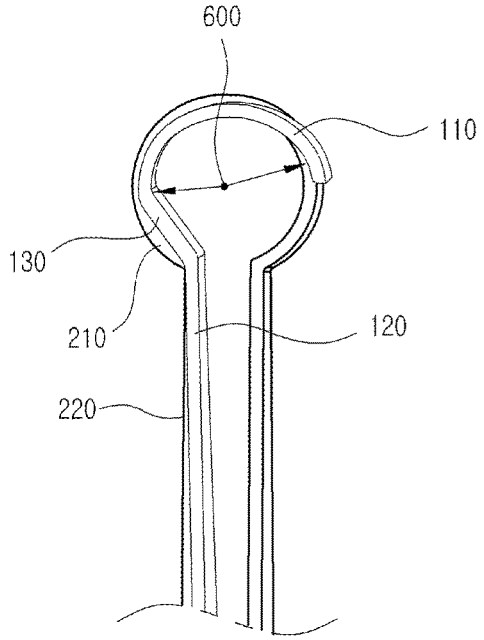

[Fig. 5]
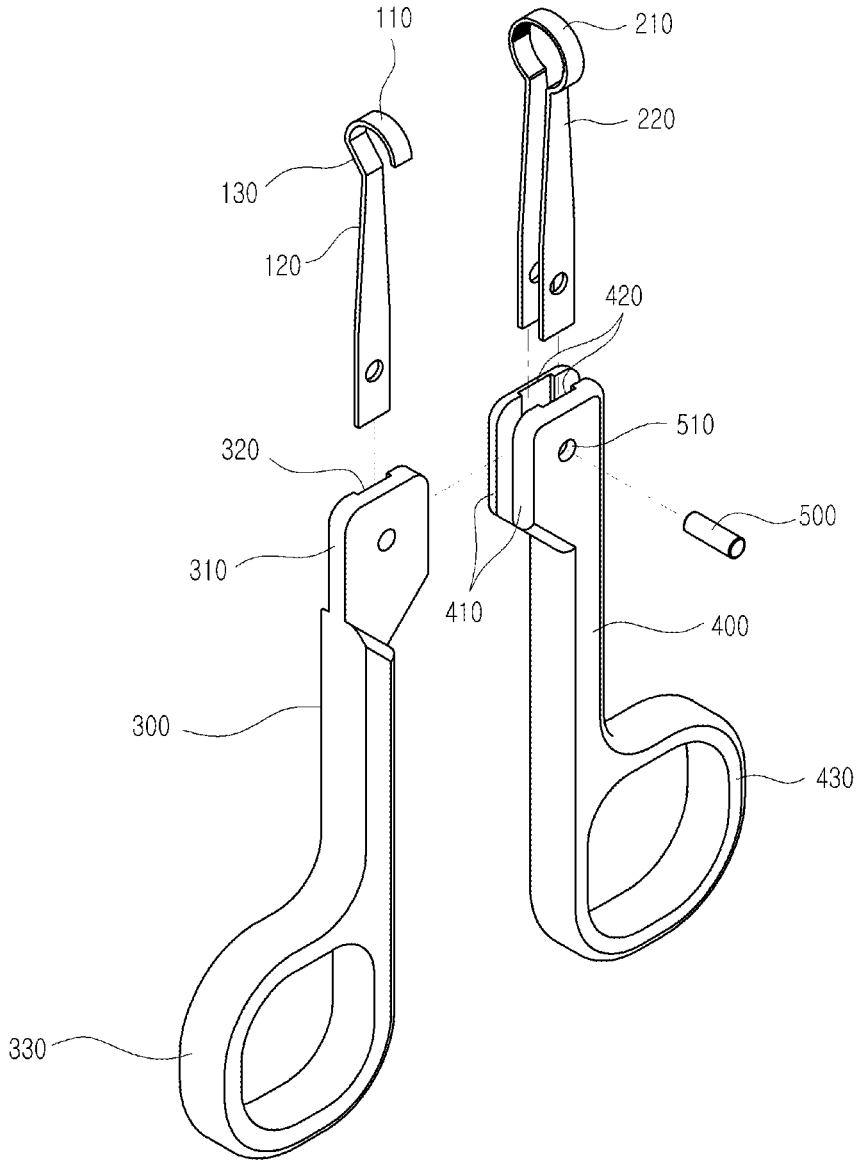

[Fig. 6]
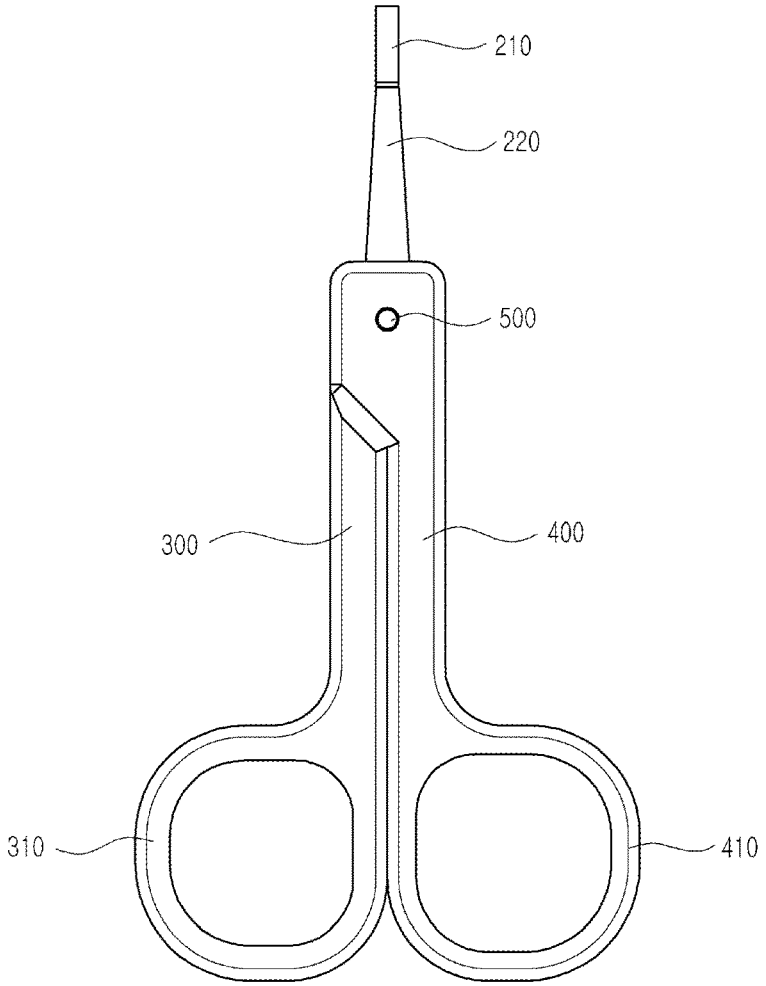
[Fig. 7]
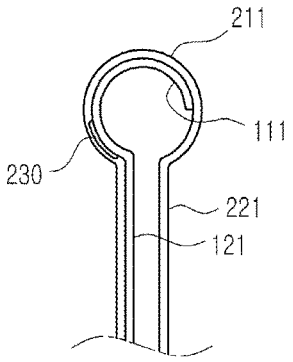

[Fig. 8]
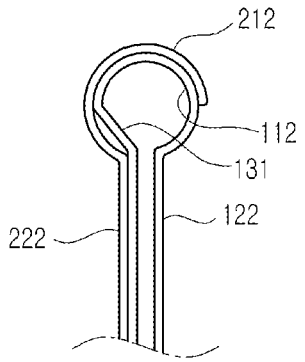
[Fig. 9]
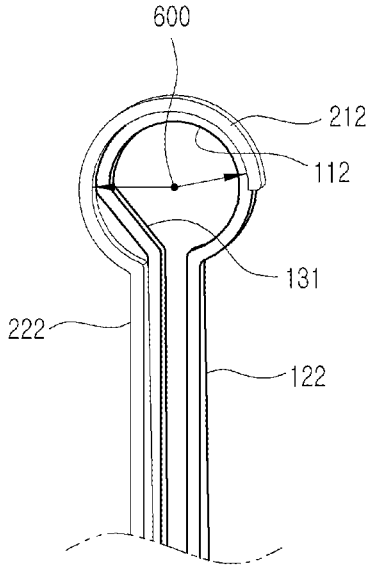

[Fig. 10]
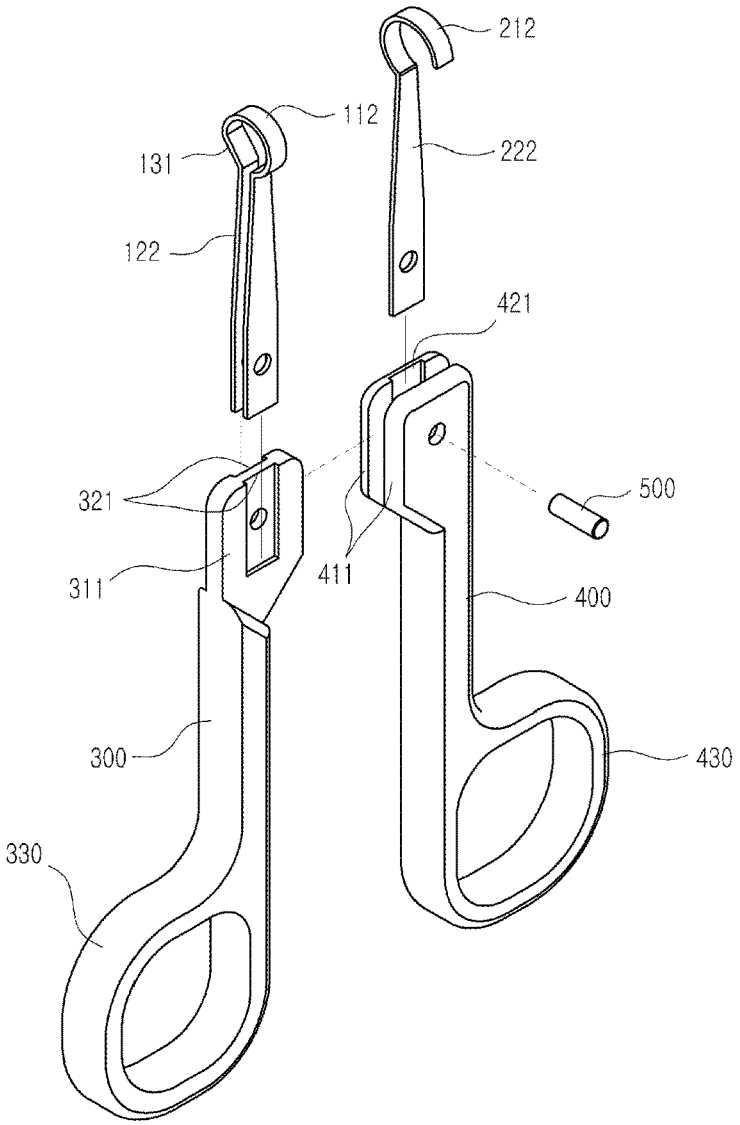
[Fig. 11]
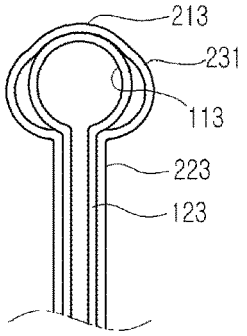

[Fig. 12]
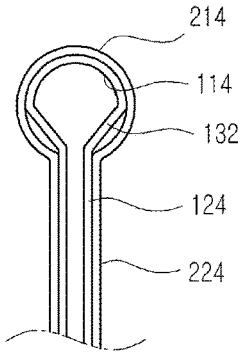
[Fig. 13]
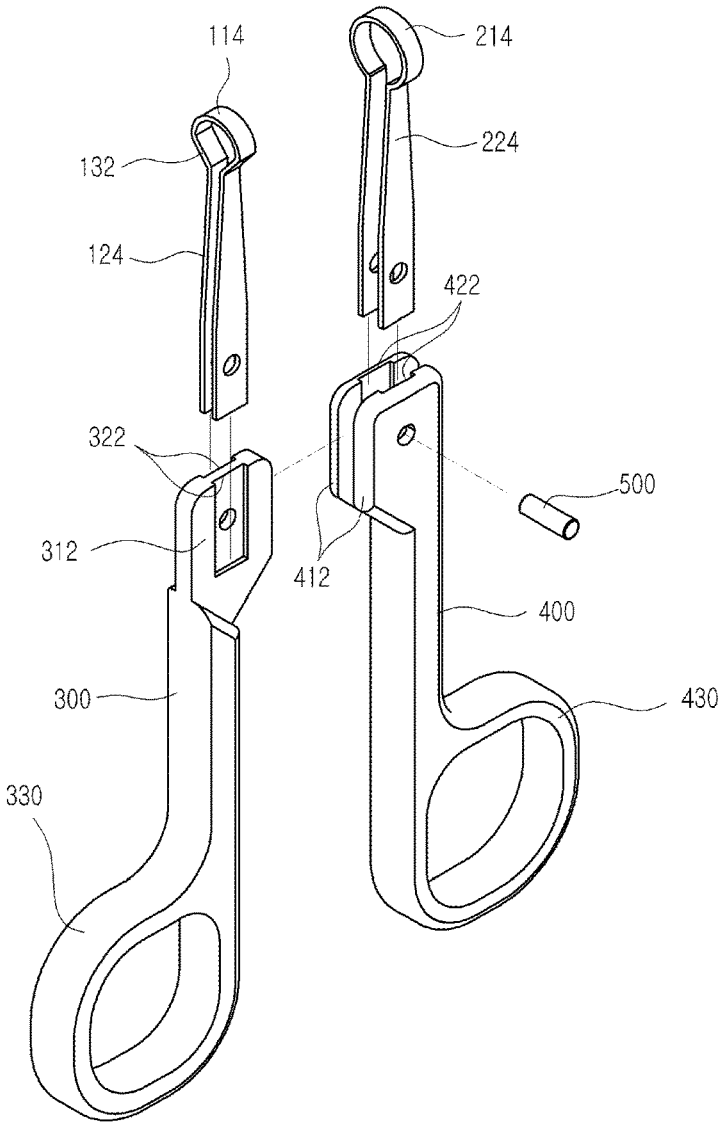

[Fig. 14]
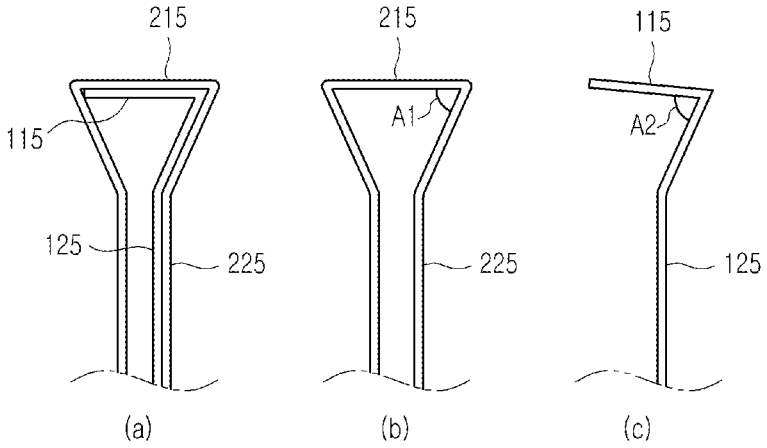

SCISSORS

TECHNICAL FIELD

The present invention relates to rounded blade scissors.

BACKGROUND ART

In general, people use nose hair trimmers or nose hair scissors in order to trim nose hair. Because a cutting blade part of such a tool directly abuts against the inside of the nose, the cutting blade part must be formed in such a way as to cut the nose hair without injuring the human body.

Moreover, because the nose hair is formed according to the internal shape of the nose, a rounded blade is provided to trim the nose hair uniformly.

Conventionally, people used relatively small scissors which can be inserted into the nose, but such scissors have a problem in that the user may be injured by the cutting blade of the scissors.

Recently, in order to solve the problem, as tools for trimming nose hair, automatic nose hair trimmers and scissors having rounded front end portion of a cutting blade have been developed, and such technologies are disclosed in Korean Patent Laid-open No. 10-2007-0016994 and Korean Utility Model Registration No. 20-0255136.

However, such nose hair trimmers have a disadvantage in that nose hair is inserted into the trimmer or a battery or a motor is out of order. Moreover, because the nose hair is cut irregularly according to the form of the cutting blade of the trimmer, it is difficult to cut the nose hair of a wanted portion in a balanced way.

Meanwhile, the scissors having the rounded front end portion of the cutting blade has a disadvantage in that it may injure the inside of the nose because only the front end portion is formed round.

Therefore, the conventional scissors also has a limitation in trimming the nose hair uniformly and conveniently. So, because the user has to trim the nose hair little by little while paying a careful attention and has to observe his or her nostrils using a mirror, it takes much time to trim the nose hair.

Moreover, the conventional scissors is very inconvenient because the user has to manipulate the scissor while perpendicularly rotating the scissors in order to effectively cut the nose hair.

Because people have to essentially manage nose hair in order to maintain cleanliness in daily life, a nose hair trimming device to solve the above-mentioned problems is needed. Therefore, people demand a nose hair trimming device to effectively cut and trim nose hair.

DISCLOSURE

Technical Problem

Accordingly, the present invention has been made in an effort to solve the above-mentioned problems occurring in the prior arts, and it is an object of the present invention to provide rounded blade scissors which provide effective cutting in safety.

Technical Solution

To achieve the above objects, the present invention provides rounded blade scissors including: a first cutting portion including a first cutting blade bent in one direction in order to cut a target; a second cutting portion including a second cutting blade having a closed annular or polygonal shape to surround the surface of the first cutting portion; a first frame portion adapted for supporting the first cutting portion on one side of the first cutting portion; a second frame portion adapted for supporting the second cutting portion on one side of the second cutting portion; and a coupling portion that hingedly couples the first frame portion with the second frame portion so that the first cutting portion comes into contact with the second frame portion through rotation, wherein the outer circumferential surface of the first cutting blade comes into contact with the inner circumferential surface of the second cutting blade when the first cutting portion rotates on the coupling portion.

Moreover, at least one of the first cutting portion and the second cutting portion comprises contact preventing means which separates a portion of the first cutting portion or the second cutting portion when the outer circumferential surface of the first cutting portion comes into contact with the inner circumferential surface of the second cutting portion.

Furthermore, the contact preventing means is bent from the outer circumferential surface of the first cutting portion to the inner circumferential surface and is located between the first cutting blade and a first supporter.

Additionally, the contact preventing means comprises a separation groove recessed from the inner circumferential surface of the second cutting portion to the outer circumferential surface and is located between the second cutting blade and a second supporter.

In addition, the first cutting portion further comprises a first supporter extending from one end of the first cutting blade in order to support the first cutting blade, and the second cutting portion further comprises at least one second supporter extending from one end of the second cutting blade in order to support the second cutting blade.

Moreover, when the first cutting blade is formed in a hook shape bent round, the second cutting blade is formed in a closed annular shape to surround the outer circumferential surface of the first cutting blade, and a straight distance from a central point of the second cutting blade to the first cutting blade is gradually reduced in a direction of the first supporter from the first cutting blade.

Furthermore, when the first cutting blade is steppedly bent at one point, the second cutting blade is formed in a closed polygonal shape to surround the outer circumferential surface of the first cutting blade, and an internal angle at the point where the first cutting blade is bent is equal to or larger than the internal angle of two adjoining straight lines which form the polygon.

Additionally, an uneven portion of a zigzag shape is formed on one side of the second cutting blade which is in contact with the first cutting blade.

In another aspect of the present invention, the present invention provides a rounded blade scissors including: a first cutting portion including a first cutting blade formed in a closed annular shape in order to cut a target; a second cutting portion including a second cutting blade bent in a hook shape to surround the surface of the first cutting portion; a first frame portion adapted for supporting the first cutting portion on one side of the first cutting portion; a second frame portion adapted for supporting the second cutting portion on one side of the second cutting portion; and a coupling portion that hingedly couples the first frame portion with the second frame portion so that the first cutting portion comes into contact with the second frame portion through rotation, wherein the outer circumferential surface of the first cutting portion comes into contact with the inner circumferential surface of the second cutting portion when the first cutting portion rotates on the coupling portion.

Moreover, the first cutting portion comprises contact preventing means which separates a portion of the first cutting portion when the outer circumferential surface of the first cutting portion comes into contact with the inner circumferential surface of the second cutting portion, and the contact preventing means is bent from the outer circumferential surface of the first cutting portion to the inner circumferential surface and is located between the first cutting blade and a first supporter.

Furthermore, the first cutting portion further comprises a first supporter extending from one end of the first cutting blade in order to support the first cutting blade, and the second cutting portion further comprises at least one second supporter extending from one end of the second cutting blade in order to support the second cutting blade.

Additionally, a straight distance from a central point of the first cutting blade to the second cutting blade is gradually reduced in a direction of the second cutting blade from the second supporter.

In a further aspect of the present invention, the present invention provides a rounded blade scissors including: a first cutting portion including a first cutting blade formed in a closed annular shape in order to cut a target; a second cutting portion including a second cutting blade having the same curvature as the first cutting blade so as to surround the surface of the first cutting portion; a first frame portion adapted for supporting the first cutting portion on one side of the first cutting portion; a second frame portion adapted for supporting the second cutting portion on one side of the second cutting portion; and a coupling portion that hingedly couples the first frame portion with the second frame portion so that the first cutting portion comes into contact with the second frame portion through rotation, wherein the outer circumferential surface of the first cutting portion comes into contact with the inner circumferential surface of the second cutting portion when the first cutting portion rotates on the coupling portion.

Moreover, the second cutting portion comprises contact preventing means which separates a portion of the second cutting portion when the outer circumferential surface of the first cutting portion comes into contact with the inner circumferential surface of the second cutting portion, and the contact preventing means is bent from the inner circumferential surface of the second cutting portion to the outer circumferential surface and is located between the second cutting blade and a second supporter.

Furthermore, the first cutting portion comprises contact preventing means which separates a portion of the first cutting portion when the outer circumferential surface of the first cutting portion comes into contact with the inner circumferential surface of the second cutting portion, and the contact preventing means is bent from the outer circumferential surface of the first cutting portion to the inner circumferential surface and is located between the first cutting blade and a first supporter.

Additionally, the first cutting portion further comprises a first supporter extending from one end of the first cutting blade in order to support the first cutting blade, and the second cutting portion further comprises at least one second supporter extending from one end of the second cutting blade in order to support the second cutting blade.

In addition, circular gripping means are respectively formed at one end of the first frame portion and at one end of the second frame portion, and the first cutting portion and the second cutting portion are respectively formed at right angles to the gripping means relative to the plane of the gripping means.

Advantageous Effects

As described above, the rounded blade scissors according to the preferred embodiments of the present invention provides the following effects.

First, differently from the cutting blades of the conventional scissors, the scissors according to the present invention provide annular cutting blades so as to reduce possibility that the user is injured.

Second, the user has to rotate the conventional scissors perpendicularly, but the scissors according to the present invention provide convenience in cutting because the cutting blades are perpendicular to a motion direction of hand-grips of the scissors.

Third, differently from the cutting blades of the conventional scissors, the scissors according to the present invention provide annular cutting blades, so that the user can uniformly cut a target.

Fourth, differently from the cutting blades of the conventional scissors, the scissors according to the present invention provide annular cutting blades, so that it increases time efficiency because the user does not need to observe his or her nostrils with a mirror while cutting the nose hair.

Fifth, because the cutting blades are perpendicular to a motion direction of hand-grips of the scissors, when there is a need to cut the target perpendicularly to the direction of the cutting blades of the conventional scissors, the scissors according to the present invention can be applied to operating scissors for medical use or scissors with other purposes.

Sixth, when the first cutting portion and the second cutting portion come in contact with each other, a portion of the first cutting portion or the second cutting portion is separated by the contact preventing means. That is, the scissors according to the present invention can prevent a deterioration of cutting efficiency due to nose hair or other target which is forcedly inserted into the cutting portions.

Seventh, because the first cutting blade or the second cutting blade having the cutting surface includes the uneven portion and a fine cutting target, such as nose hair, is located and cut on the uneven portion, the scissors according to the present invention can cut the target easily and rapidly.

DESCRIPTION OF DRAWINGS

FIG. 1 is a perspective view of rounded blade scissors according to a first preferred embodiment of the present invention.

FIG. 2 is a front view of first and second cutting portions of the rounded blade scissors according to the first preferred embodiment.

FIG. 3 is a perspective view of the rounded blade scissors according to the first preferred embodiment.

FIG. 4 is a front view of the first and second cutting portions of the rounded blade scissors according to the first preferred embodiment.

FIG. 5 is an exploded perspective view of the rounded blade scissors according to the first preferred embodiment.

FIG. 6 is a side view of the rounded blade scissors according to the first preferred embodiment.

FIG. 7 is a front view of first and second cutting portions of the rounded blade scissors according to a second preferred embodiment.

FIGS. 8 and 9 are front views of first and second cutting portions of the rounded blade scissors according to a third preferred embodiment.

FIG. 10 is an exploded perspective view of the rounded blade scissors according to the third preferred embodiment.

FIG. 11 is a front view of first and second cutting portions of the rounded blade scissors according to a fourth preferred embodiment.

FIG. 12 is a front view of first and second cutting portions of the rounded blade scissors according to a fifth preferred embodiment.

FIG. 13 is an exploded perspective view of the rounded blade scissors according to the fourth preferred embodiment.

FIG. 14 is a front view of first and second cutting portions of the rounded blade scissors according to a sixth preferred embodiment.

EXPLANATION OF ESSENTIAL REFERENCE NUMERALS IN DRAWINGS

10: rounded blade scissors
100: first cutting portion
110,111,112,113,114,115: first cutting blade
120,121,122,123,124,125: first supporter
130,131,132: contact preventing means
200: second cutting portion
210,211,212,213,214,215: second cutting blade
220,221,222,223,224,225: second supporter
230,231: contact preventing means
240: uneven portion
300: first frame portion
310,311,312: fixing plate
320,321,322: fixing groove
330: gripping means
400: second frame portion
410,411,412: fixing plate
420,421,422: fixing groove
430: gripping means
500: coupling portion
510: coupling hole
600: central point
A1,A2: internal angle

MODE FOR INVENTION

Reference will be now made in detail to the preferred embodiment of the present invention with reference to the attached drawings. In the present invention, description of the same configuration and action as the prior arts will be omitted.

Rounded blade scissors 10 according to a preferred embodiment of the present invention includes a first cutting portion 100, a second cutting portion 200, a first frame portion 300, a second frame portion 400, a coupling portion 500, and contact preventing members 130, 131, 132, 230 and 231. Referring to FIGS. 1 to 13, the rounded blade scissors 10 will be described in more detail.

The first cutting portion 100 is disposed in order to cut a target, and includes a first cutting blade 110, 111, 112, 113 or 114, and a first 120, 121, 122, 123 or 124. Each of the first cutting blades 110, 111, 112, 113 and 114 includes a cutting surface inclined in one direction in order to cut the target.

The first supporter 120, 121, 122, 123 or 124 extends from one end of the first cutting blade 110, 111, 112, 113 and 114 for supporting the first cutting blade 110, 111, 112, 113 or 114 and is formed integrally with the first cutting blade 110, 111, 112, 113 or 114. At least one first supporter 120, 121, 122, 123 or 124 may be formed according to the look of the first cutting blade 110, 111, 112, 113 or 114.

The second cutting portion 200 cuts a target in contact with one surface of the first cutting portion 100, and includes a second cutting blade and a second supporter. The second cutting blade cuts the target in contact with one surface of the first cutting blade 110, 111, 112, 113 or 114, and includes a cutting surface inclinedly formed at one side thereof in one direction.

The first frame portion 300 is joined with the first supporter 120, 121, 122, 123 or 124 of the first cutting portion 100 so as to support the first cutting portion 100, and may extend from one side of the first cutting portion 100 so as to be formed integrally with the first cutting portion 100 or may be formed separately from the first cutting portion 100 and joined with the first cutting portion 100.

In the case that the first frame portion 300 is formed separately from the first cutting portion 100 and joined to the first cutting portion 100, the first frame portion 300 includes a fixing plate 310, 311 or 312 which fixes the first supporter 120, 121, 122, 123 or 124, and a fixing groove formed in one side of the fixing plate 310, 311 or 312 so that the first supporter 120, 121, 122, 123 or 124 is inserted and joined to the fixing plate 310, 311 or 312.

The second frame portion 400 is joined with the second supporter of the second cutting portion 200 so as to support the second cutting portion 200, and may extend from one side of the second cutting portion 200 so as to be formed integrally with the second cutting portion 200, or may be formed separately from the second cutting portion 200 and be joined with the second cutting portion 200.

In the case that the second frame portion 400 is formed separately from the second cutting portion 200 and joined with the second cutting portion 200, the second frame portion 400 includes at least one fixing plate 410, 411 or 412 which fixes the second supporter and a fixing groove formed in one side of the fixing plate 410, 411 or 412 so that the second supporter is inserted and joined to the fixing plate 410, 411 or 412.

In the meantime, according to forms of the first cutting blades 110, 111, 112, 113 and 114 and the second cutting blades, a plurality of supporters which support the cutting blades may be formed, and thus, the number of he fixing plates or the fixing grooves for fixing the supporters may be changed.

In the case that the first frame portion 300 and the second frame portion 400 are formed separately from the first cutting portion 100 and the second cutting portion 200, the first cutting blades 110, 111, 112, 113 and 114 or the second cutting blades which are worn out due to a long-term use can be easily replaced. Moreover, because the first cutting portion 100, the second cutting portion 200, the first frame portion 300 and the second frame portion 400 are hingedly coupled by one coupling portion 500, the rounded blade scissors 10 can be easily manufactured and can be reduced in manufacturing cost.

Meanwhile, the first frame portion 300 and the second frame portion 400 respectively have circular gripping means formed at one end thereof so that a user can grip the scissors with his or her fingers, and the first cutting portion 100 and the second cutting portion 200 are respectively formed at right angles to the gripping means relative to the plane of the gripping means.

The coupling portion 500 joins the first frame portion 300 and the second frame portion 400 by a hinge so as to cut the target by getting in contact with the second cutting portion 200 by rotation of the first cutting portion 100. That is, the first cutting portion 100 and the second cutting portion 200 are rotatable on the coupling portion 500 in right and left directions.

The contact preventing members 130, 131, 132, 230 or 231 are disposed on at least one of the first cutting portion 100 and the second cutting portion 200, and separate a portion of the first cutting portion 100 or the second cutting portion 200 when the first cutting portion 100 gets in contact with the second cutting portion 200. Furthermore, a plurality of the contact preventing members 130, 131, 230 or 231 may be formed according to forms of the first cutting portion 100 and the second cutting portion 200.

First Embodiment

The first cutting blade 110 according to the first preferred embodiment of the present invention is formed in a hook which is bent roundly with a predetermined curvature, and the second cutting blade 210 is formed in a closed annular shape so as to surround the outer circumferential surface of the first cutting blade 110. As shown in FIG. 2, in the case that the first cutting blade 110 is in contact with the second cutting blade 210, the first cutting blade 110 is close to the bottom of the second cutting blade 210 of the annular shape.

The contact preventing member 130 according to the first preferred embodiment of the present invention is located between the first cutting blade 110 and the first supporter 120. When the outer circumferential surface of the first cutting blade 110 comes in contact with the inner circumferential surface of the second cutting blade 210, the contact preventing member 130 is bent from the outer circumferential surface of the first cutting portion 100 toward the inner circumferential surface so that a portion of the first cutting portion 100 is separated from the second cutting portion 200, thereby creating an empty space between the second cutting portion 200 and the contact preventing member 130.

In other words, only the first cutting blade 110 and the second cutting blade 210 which respectively have the cutting surfaces are in contact with each other and an empty space is formed between the first cutting portion 100 and the second cutting portion 200 by the contact preventing member 130 formed on the first cutting portion 100, such that the rounded blade scissors according to the preferred embodiment of the present invention can prevent deterioration of cutting efficiency by nose hair getting in the remaining portion except the first cutting blade 110.

On one side of the second cutting blade 210 which is in contact with the first cutting blade 110, an uneven portion 240 of a zigzag shape is formed on one side of the second cutting blade 210 which is in contact with the first cutting blade 110. In FIG. 2, the uneven portion 240 is formed in a serrated shape, but the uneven portion may adopt any shape if it is formed in the zigzag shape having a curve, and as occasion demands, the first cutting blade 110 which comes into contact with the uneven portion 240 of the second cutting blade 210 may also have such an uneven portion 240.

Meanwhile, as shown in FIG. 4, the first cutting blade 110 is formed in such a manner that a straight distance in a radial direction from a central point 600 of the second cutting blade 210 to the first cutting blade 110 is gradually reduced from one end of the first cutting blade 110 to the other end of the first blade 110 toward the contact preventing member. Here, the central point 600 of the second cutting blade 210 means a point for forming a substantially annular circumference of the second cutting blade 210.

Therefore, when the outer circumferential surface of the first cutting blade 110 comes into close contact with the inner circumferential surface of the second cutting blade 210 by the user, a predetermined pressure is generated while the first cutting blade 110 comes into close contact with the second cutting blade 210, and in this instance, the cutting efficiency is increased by the generated pressure.

As shown in FIG. 5, the fixing plate 310 of the first frame portion 300 is located between the two fixing plates 410 of the second frame portion 400 and rotates on the coupling portion 500 so as to carry out a cutting action.

In the meantime, because the first cutting blade 110 and the second cutting blade 210 respectively have the cutting surfaces inclined in one direction, if the user's nose hair is located on the uneven portion of the second cutting blade 210, the first cutting blade 110 slides along the inclined cutting surface of the second cutting blade 210 in the state where it is in contact with the second cutting blade 210 so as to carry out the cutting action, thereby enhancing cutting efficiency.

Second Embodiment

The cutting blade 111 according to the second preferred embodiment of the present invention is formed in a hook and the second cutting blade 211 is formed in a closed annular shape. When the first cutting blade 111 comes into contact with the second cutting blade 211, the outer circumferential surface of the first cutting blade 111 comes into contact with the inner circumferential surface of the second cutting blade 211 in the same way as the first preferred embodiment.

As shown in FIG. 7, the contact preventing means 230 of the second preferred embodiment is located between the second cutting blade 211 and the second supporter 221, and has a separation groove recessed from the inner circumferential surface of the second cutting portion 200 in a direction of the outer circumferential surface. That is, the contact preventing means 230 separates a portion of the second cutting portion 200 from the first cutting portion 100 when the outer circumferential surface of the first cutting blade 111 comes into contact with the inner circumferential surface of the second cutting blade 211.

It is also possible that the first cutting blade 111 or the second cutting blade 211 of the second preferred embodiment has the same uneven portion 240 as the first preferred embodiment. The first cutting blade 111 is formed in such a manner that a straight distance from a central point 600 of the second cutting blade 211 to the first cutting blade 111 is gradually reduced from the first cutting blade 111 to the first supporter 121.

Third Embodiment

The cutting blade 112 according to the third preferred embodiment of the present invention is formed in a closed annular shape, and the second cutting blade 212 is formed in a hook. As shown in FIG. 8, in the case that the first cutting blade 112 is in contact with the second cutting blade 212, the first cutting blade 112 is close to the bottom of the hook-shaped second cutting blade 212, such that the outer circumferential surface of the first cutting blade 112 comes into contact with the inner circumferential surface of the second cutting blade 212.

As shown in FIG. 9, the second cutting blade 212 is formed in such a manner that a straight distance in a radial direction from a central point 600 of the first cutting blade 112 to the second cutting blade 212 is gradually reduced from one end of the second cutting blade 212 toward the contact preventing member to the other end of the second cutting blade 212.

The contact preventing member 131 according to the third preferred embodiment of the present invention is located between the first cutting blade 112 and the first supporter 122. When the outer circumferential surface of the first cutting blade 112 comes in contact with the inner circumferential surface of the second cutting blade 212, the contact preventing member 131 is bent from the outer circumferential surface of the first cutting portion 100 toward the inner circumferential surface so that a portion of the first cutting portion 100 is separated from the second cutting portion 200.

Of course, according to the embodiments, the contact preventing means 131 may be located between the second cutting blade 212 and the second supporter 222, and may have a separate groove recessed from the inner circumferential surface of the second cutting blade 212 toward the outer circumferential surface.

Fourth Embodiment

The rounded blade scissors according to the fourth preferred embodiment of the present invention include: the first cutting blade 113 and the second cutting blade 213 which are respectively formed in a closed annular shape; and a plurality of first supporters 123 and a plurality of second supporters 223 for supporting the cutting blades. A diameter of the second cutting blade 213 is larger than a diameter of the first cutting blade 113.

As shown in FIG. 11, the contact preventing means 231 is located between the second cutting blade 213 and the second supporter 223. Moreover, the contact preventing means 231 is bent from the inner circumferential surface of the second cutting portion 200 toward the outer circumferential surface so that a portion of the first cutting portion 100 is separated from the second cutting portion 200 when the outer circumferential surface of the first cutting blade 113 comes into contact with the inner circumferential surface of the second cutting blade 213.

Furthermore, in the fourth preferred embodiment, because the first cutting blade 113 and the second cutting blade 213 are formed in the closed annular shape, it is preferable that the contact preventing means 231 be formed between the second cutting blade 213 and a plurality of the second supporter 223 which support the second cutting blade 213.

Fifth Embodiment

The rounded blade scissors according to the fifth preferred embodiment of the present invention include: the first cutting blade 114 and the second cutting blade 214 which are respectively formed in a closed annular shape; and a plurality of first supporters 124 and a plurality of second supporters 224 for supporting the cutting blades. A diameter of the second cutting blade 214 is larger than a diameter of the first cutting blade 114.

As shown in FIG. 12, the contact preventing means 132 is located between the first cutting blade 114 and the first supporter 124. Moreover, the contact preventing means 132 is bent from the outer circumferential surface of the first cutting portion 100 toward the inner circumferential surface so that a portion of the first cutting portion 100 is separated from the second cutting portion 200 when the outer circumferential surface of the first cutting blade 114 comes into contact with the inner circumferential surface of the second cutting blade 214.

Additionally, in the fifth preferred embodiment, because the first cutting blade 114 and the second cutting blade 214 are formed in the closed annular shape, it is preferable that the contact preventing means 132 be formed between the first cutting blade 114 and a plurality of the first supporter 124 which support the first cutting blade 114.

Sixth Embodiment

The first cutting blade 115 according to the sixth preferred embodiment of the present invention is steppedly bent at one point in the form of "¬" shape, and the second cutting blade 215 is formed in a closed polygonal shape to surround the outer circumferential surface of the first cutting blade 115.

When the first cutting blade 115 comes into contact with the second cutting blade 215, the outer circumferential surface of the first cutting blade 115 comes into contact with the inner circumferential surface of the second cutting blade 215 in the same way as the first preferred embodiment.

Meanwhile, as shown in FIG. 14, an internal angle A2 at the point that the first cutting blade 115 is bent is equal to inner angles A1 of two adjoining straight lines of the polygonal second cutting blade 215 or is larger than the internal angles A1 of the two adjoining straight lines.

When the outer circumferential surface of the first cutting blade 115 comes in close contact with the inner circumferential surface of the second cutting blade 215 by the user, in the case that the internal angle A2 of the first cutting blade is larger than the internal angle A1 of the second cutting blade, a predetermined pressure is generated while the first cutting blade 115 comes into close contact with the second cutting blade 215, and in this instance, the cutting efficiency is increased by the generated pressure, and the rounded blade scissors according to the sixth preferred embodiment can cut the target with stronger power than other cutting blade having the same internal angle.

As described above, while the present invention has been particularly shown and described with reference to the example embodiments thereof, it will be understood by those of ordinary skill in the art that the above embodiments of the present invention are all exemplified and the present invention is not limited to the above embodiment. Therefore, it would be understood that the technical and protective scope of the present invention shall be defined by the technical idea as defined by the following claims and the equivalences.

The invention claimed is:

1. A scissors comprising:

a first cutting portion comprising a first cutting blade bent in one direction in order to cut a target, a contact preventing member extending from one end of the first cutting blade, and a first supporter extending from one end of the contact preventing member in order to support the first cutting blade;

a second cutting portion comprising a second cutting blade having a closed substantially annular shape to surround a surface of the first cutting portion and at least one second supporter extending from one end of the second cutting blade in order to support the second cutting blade;

a first frame portion adapted for supporting the first cutting portion on one side of the first cutting portion;

a second frame portion adapted for supporting the second cutting portion on one side of the second cutting portion; and a coupling portion that hingedly couples the first frame portion with the second frame portion so that the first cutting portion comes into contact with the second cutting portion through rotation of the first and second frame portions about the coupling portion, wherein an outer circumferential surface of the first cutting blade is configured to comes into contact with an inner circumferential surface of the second cutting blade when the first cutting portion rotates about the coupling portion, wherein the first cutting blade is formed in a hook shape bent round, and the second cutting blade formed in the closed substantially annular shape is configured to surround the outer circumferential surf ace of the first cutting blade, the outer circumferential surface of the first cutting blade being formed on the opposite side of an inner circumferential surface of the first cutting blade, wherein the first cutting blade is joined at one end to an anterior most point of the first supporter by the contact preventing member, the contact preventing member being bent from the outer circumferential surface of the first cutting blade toward the inner circumferential surface of the first cutting blade so that a portion of the first cutting portion is separated from the second cutting portion, thereby creating an empty space between the second cutting portion and the contact preventing member, wherein a circular gripping means is respectively formed on each support at one end of the first frame portion and at one end of the second frame portion, and the first cutting portion and the second cutting portion are respectively formed at right angles to the gripping means relative to a plane of the gripping means so that the first and second cutting blades are perpendicular to a motion direction of the gripping means, and wherein an upper edge of the first cutting portion is an integral extension of an upper edge of the first supporter, the upper edge of the first cutting portion extending from the upper edge of the first supporter in a plane perpendicular to the plane of the circular gripping means.

2. The scissors according to claim 1, wherein an uneven portion of a zigzag shape is formed on one side of the second cutting blade which is in contact with the first cutting blade.

3. The scissors according to claim 1, wherein the first cutting blade is indirectly joined at the one end to the anterior most point of the first supporter via the contact preventing member.

4. The scissors according to claim 3, wherein the contact preventing member is formed in a blade shape.

* * * * *